United States Patent [19]

Kirk, Jr.

[11] 4,420,096

[45] Dec. 13, 1983

[54] CHILD-RESISTANT ACTUATOR COVER

[75] Inventor: Donald C. Kirk, Jr., Midlothian, Va.

[73] Assignee: Ethyl Products Company, Richmond, Va.

[21] Appl. No.: 273,003

[22] Filed: Jun. 12, 1981

Related U.S. Application Data

[63] Continuation-in-part of Ser. No. 826,276, Aug. 22, 1977, abandoned.

[51] Int. Cl.[3] ..... B65D 47/34

[52] U.S. Cl. ..... 222/44; 222/153; 222/321; 222/384; 222/402.11

[58] Field of Search ..... 222/153, 402.11, 182, 222/321, 384, 44, 48

[56] References Cited

U.S. PATENT DOCUMENTS 3,601,290 8/1971 Nigro ..... 222/402.11

4,057,176 11/1977 Horvath ..... 222/384 X 4,071,173 1/1978 Horan ..... 222/402.11 X

*Primary Examiner*—Joseph J. Rolla

*Assistant Examiner*—Frederick R. Handren

*Attorney, Agent, or Firm*—Donald L. Johnson; John F. Sieberth

[57] ABSTRACT

An actuator assembly for a dispensing device including a cap for engagement with a container neck, the cap having a series of arcuate protuberances therein, an operable dispensing button with a discharge orifice, the button having a series of tabs thereon, a cover piece enclosing the button which exposes a portion of the button for finger engagement, and a guide slot in the cover piece to prevent relative movement between the button and the cover piece. The arcuate protuberances and the tabs cooperate to prevent fluids from being dispensed from the dispensing container until the protuberances and tabs are properly aligned.

14 Claims, 20 Drawing Figures

CHILD-RESISTANT ACTUATOR COVER

This application is a continuation-in-part of application Ser. No. 826,276, filed Aug. 22, 1977, now abandoned.

BACKGROUND OF THE INVENTION

This invention relates to actuator caps for small liquid dispensers and more particularly to caps which are mounted or secured in place by means of screw threads. Dispensing containers of the hand-held variety, for example, aerosol or spray pump types, are used quite commonly for packaging and dispensing a multiplicity of products. Many of the products dispensed could cause harm to uninformed users such as children. Products dispensed may include paint, lacquers, oil, hair spray, insecticide, cleansers, paint removers, oven cleaners, etc. Obviously, due to the hazardous nature of such materials, unauthorized utilization of such should be prevented.

Fortunately, there are many so-called "child-resistant" devices presently on the market to prevent dispensing of harmful products by children. However, most of these devices rely upon either the difference of strength or manual coordination between an adult and a child. Such reliance often results in frustration for adults who do not have the strength and manual dexterity even though they have the mental maturity to affect dispensing of the product. This is especially true of persons suffering from arthritis or other debilitating diseases. Thus, there is a need for a child-resistant actuator which may be utilized on dispensing containers which-do not rely on any difference of strength or manual coordination between and adult and a child.

It is therefore an object of this invention to provide a child-resistant device which may be utilized on dispensing containers which is highly child-resistant but which, at the same time, is easily used by adults. Indeed, the actuator of this invention is particularly suitable for use even by adults suffering from physical disabilities of the hands.

THE INVENTION

In accordance with the present invention there is provided an actuator assembly for a dispensing device including a cap for engagement with a container neck, the cap having a series of arcuate protuberances therein, an operable dispensing button with a discharge orifice, the button having a series of tabs thereon, a cover piece enclosing the button which exposes a portion of the button for finger engagement, and a guide slot in the cover piece to prevent relative movement between the button and the cover.

DESCRIPTION OF THE PREFERRED EMBODIMENTS

Figure 1:
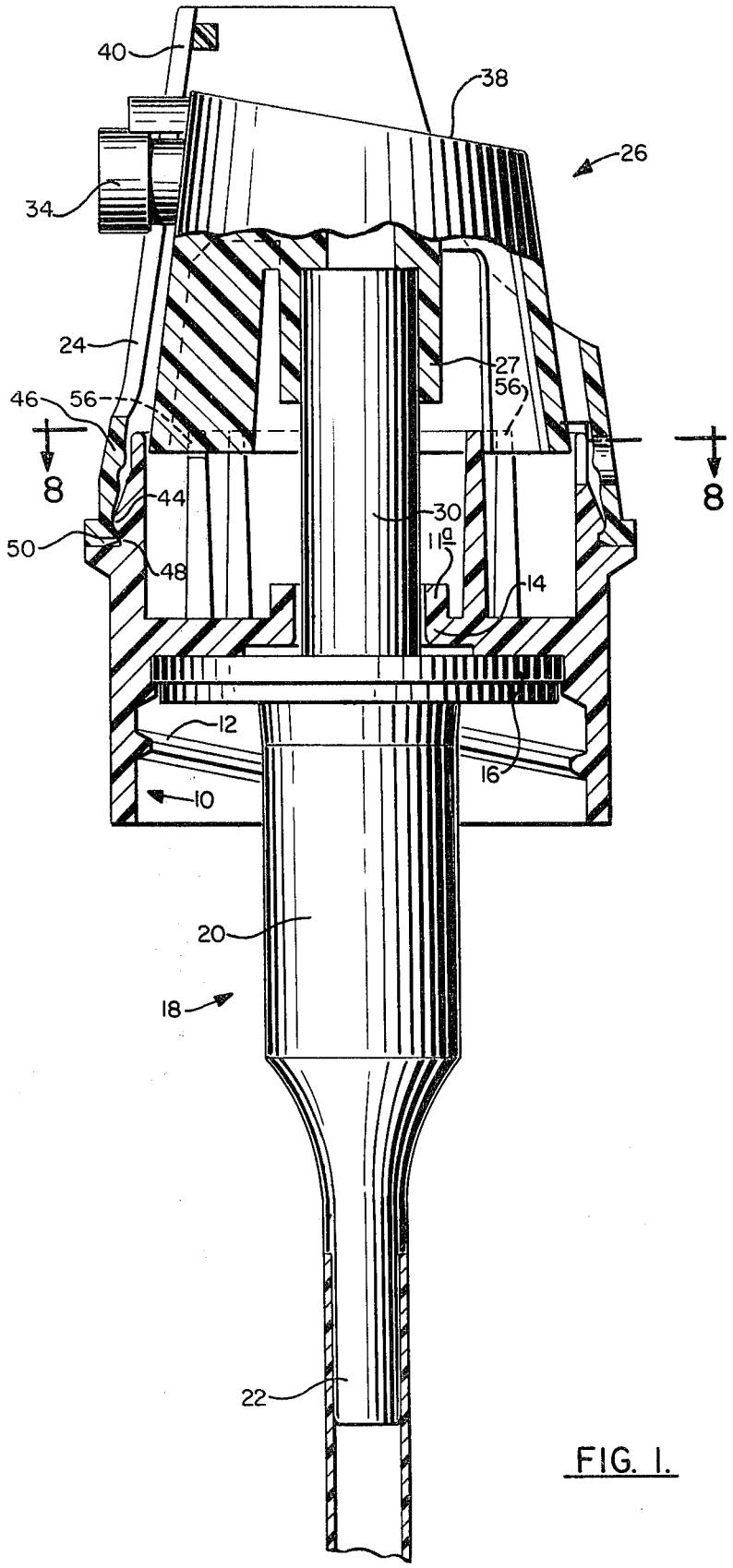
FIG. 1 is a partly sectional, side elevational view of the assembly of the present invention.

As shown in the drawings, the actuator assembly includes a dispensing pump assemblage which is intended to be removably mounted on a container of the type having a threaded neck. If desired, the threads can be deleted on the cap and the cap could be attached by such conventional means as snapping or the like. Containers used with such assemblages include glass or plastic bottles, and are well-known in the art.

Figure 4:
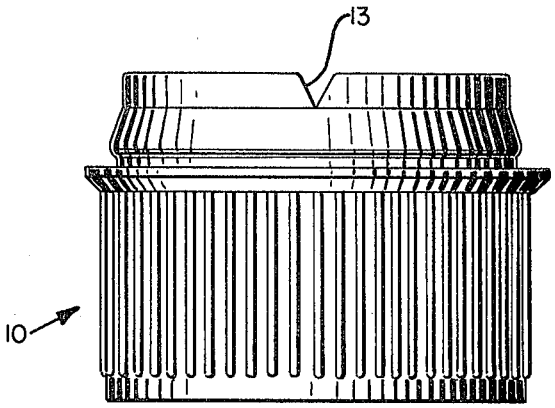
FIG. 4 is a side elevational view of the cap body piece of the present invention.
Figure 5:
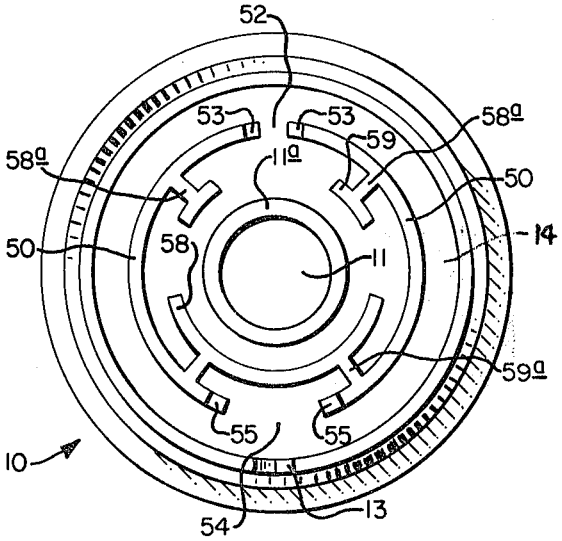
FIG. 5 is a top plan view of the cap body piece of FIG. 4.

The actuator assemblage includes a cap body piece designated generally by the numeral 10, as shown in FIGS. 1, 4, and 5 having internal screw threads 12 arranged for engagement with the usual threaded neck of a bottle. The cap body piece 10 has an internal annular flange 14 against which there is fitted a cooperable annular flange 16 of a pump assemblage generally designated by the numeral 18.

The pump assemblage 18 comprises a plastic housing 20 in which there is a cylinder and piston or plunger (not shown). The housing has a dependent dip or siphon tube 22 arranged to extend into the container to the bottom thereof. The pump assemblage 18 may be of any usual type, one suitable for use in the present actuator cap assemblage being that described in detail in the U.S. Pat. No. 3,159,316, of O'Donnell and Steiman, dated Dec. 1, 1964, and entitled "Atomizer Pump".

When the actuator assemblage is mounted on a container, the cap body piece 10 will be screwed down tightly so that the top lip of the container opening (not shown) engages the annular flange 16 of the pump assemblage 18 thereby to provide a seal which prevents leakage of the container contents. For such arrangement, the cap body piece 10 may have various different rotative positions on the container, depending on the disposition of the internal screw threads 12 as well as the disposition of the cooperable external threads on the container neck.

Provided on the cap body piece 10 is an operable button generally indicated at 26 having a one-sided discharge orifice, the button being both vertically movable and turnable or rotatably movable on the cap body piece 10, as well as a cover piece, generally indicated at 24, which encloses the cap body piece and is also mounted on the cap body piece 10. The cover piece provides clearance for the side-discharge orifice of the button and is frictionally held by the body in such a manner that it may be rotatably adjusted with the button to enable the two to be turned so as to orient them with respect to the container and cap body piece 10. Aside from adjustable rotative movement, the cover piece does not have any other movement but instead is rigidly and securely mounted on the cap body piece 10.

The button 26 is secured to a vertically movable plunger shank 30 on pump assemblage 18. The flange 16, cylinder 20, and shank 30 constitute means for movably mounting the button 26 on the cap body piece 10.

Figure 2:
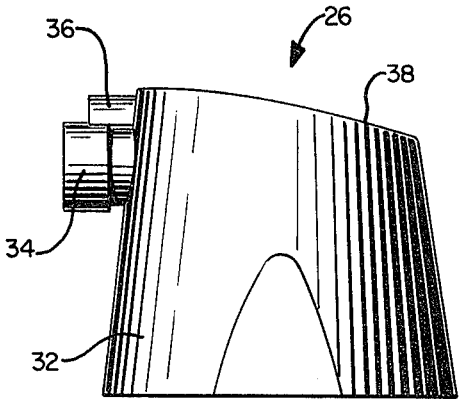
FIG. 2 is a side elevational view of the operable button of the pump assembly of the present invention.
Figure 3:
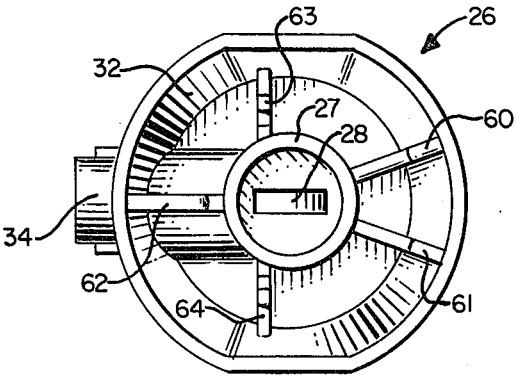
FIG. 3 is a bottom plan view of the operable button of FIG. 2.

The button 26, shown in detail in FIGS. 2 and 3, comprises a conical body 32 having projecting side orifice or nozzle 34 and a nozzle cover 36 whereby liquid passing up through the hollow plunger shank 30 flows upwards through passageways (not shown) and conical body 32 and is ejected from the orifice 34, either in the form of a fine spray or else as a stream of viscous liquid substance. The conical body 32 has a sloping top 38 for engagement by the finger of the user, and it will be understood that (as is conventional) the pump assemblage 18 includes a plunger return spring (not shown) which normally maintains the shank 30 of the bottom 32 in the raised, non-discharging position of FIG. 1.

Figure 6:
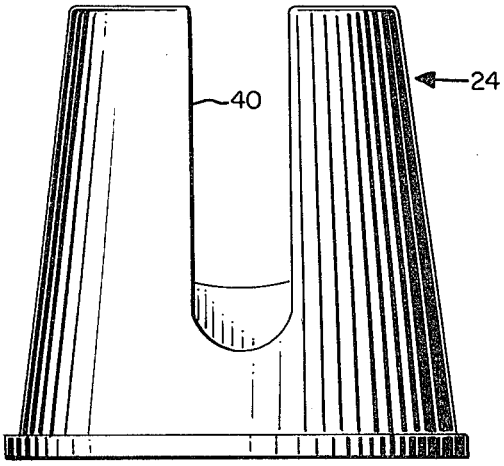
FIG. 6 is a front elevational view of the cover piece of the pump assembly of the present invention.
Figure 7:
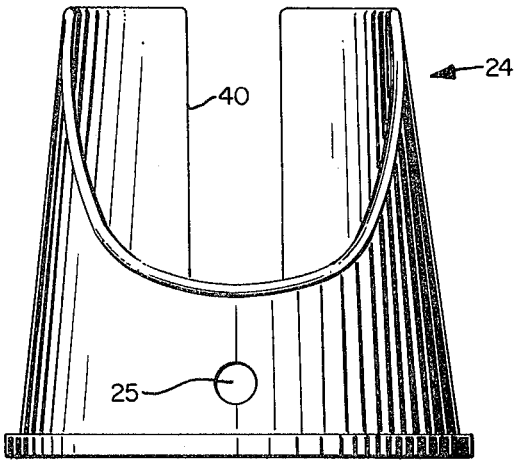
FIG. 7 is a back elevational view of the cover piece of the present invention.

The cover piece 24, shown in FIGS. 6 and 7, is also of conical configuration having in one side wall a vertical slot 40 in which nozzle cover 36 is guided and with which it cooperates to prevent relative turning movement between the button and the cover piece. A friction mounting is provided on the cover piece 24 and cap body piece 10 which yieldably holds the cover piece and button 32 in different adjusted rotative positions with respect to the cap body piece 10 thereby to enable the cover piece and button to be rotatably adjusted with respect to the container on which the cap is attached. The friction mounting comprises inner-fitting rim portions 44 and 46 of the cap body piece and the cover piece, the rim portions having internal and external shoulders 48 and 50, respectively, which are respectively of smaller and larger diameters to provide an interlock between the cover piece and the cap body piece while at the same time enabling adjustable, rotatable movement of the cover piece to be affected with respect to the cap body piece.

Referring now to FIGS. 1, 2, and 3, button 26 can be seen to have, extending downward from the top thereof, a series of tabs 60 and 61 which are identical and a larger tab 62, larger tab 62 being aligned with the nozzle 34. Also extending downwardly are two guides 63 and 64. A cylindrical sleeve 27 extends downward for receipt of shank 30 as does passageway 28 which conveys fluid from shank 30 to nozzle 34.

The cover piece 24 and cap body piece 10, as well as the button 26, are preferably molded out of resilient plastic substances such as polyethylene or similar formulations, and at least one of the interlocking pieces are sufficiently yieldable to enable a snap fit to be effected. Preferably both the cap body piece 10 and cover piece 24 are resilient, whereby both rim portions yield to a slight extent to enable the assembly of the pieces to be easily effected.

Once the cap body piece and cover piece are assembled, they do not normally come apart but instead the cover piece provides a guide for nozzle 34 as well as a protective guard for button 26, preventing inadvertent operation of the button and insuring that the nozzle or orifice is always properly pointed or oriented. At the time the actuator assemblage is mounted on the container, the latter may be oriented with respect to the cover piece 24 and nozzle 34 by merely turning the cover piece in either direction while holding the container.

In FIG. 5 the cap body piece 10 can be seen to contain a central hole 11 therein for receipt of shank 30. Hole 11 is surrounded by cylindrical walls **11*a* which serve to form a receptacle for shank 30. Extending upwardly from flange 14 of cap body piece 10 are two arcuate protuberances 50—50 which form a small vertical slot 52 therebetween and a large vertical slot 54 therebetween. The arcuate protuberances 50—50 terminate in a top flat edge 56 as can be seen in FIG. 1. Arcuate protuberances 50—50 have cammed or curved portions 53—53 at the top edges of slot 52 and cammed or curved portions 55—55 at the top edges of slot 54. One intermediate arcuate structural member 58 and two small arcuate structural members 59 extend upwardly from annular flange 14 and are connected to arcuate protuberance 50—50 by legs 59*a*—59*a* and 58*a*—58*a***, respectively.

In one embodiment of the invention cap body piece 10 is shown in FIG. 4 to contain a V-notch 13 at the upper end thereof. V-notch 13, when aligned with hole 25 of cover piece 24, indicates the actuator assembly is in proper position for dispensing fluids when button 26 is depressed.

Figure 9:
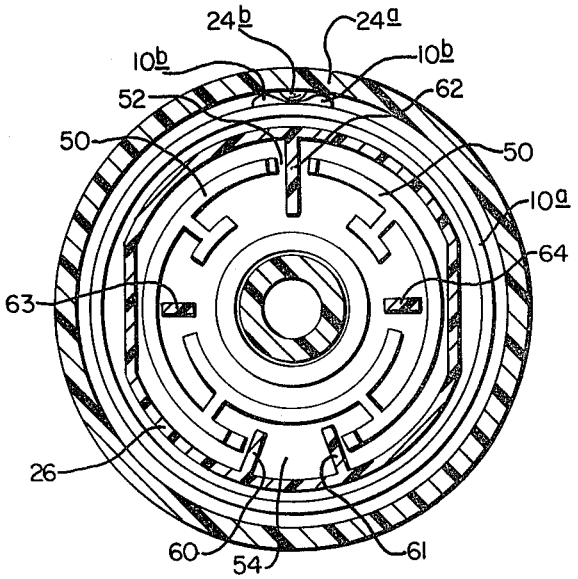
FIG. 9 is a cross-sectional view showing another embodiment of the present invention.
Figure 9A:
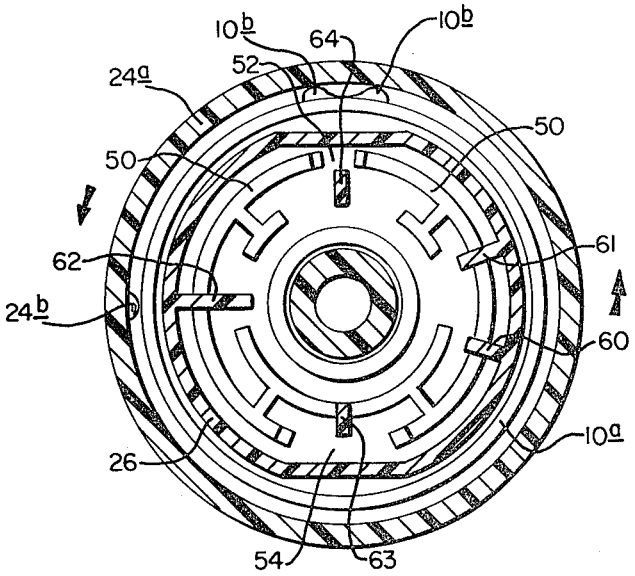
FIG. 9A is a cross-sectional view of FIG. 9 in which the pump assembly has been rotated from the position shown in FIG. 9.

In another embodiment of the invention, as shown in FIG. 9, hole 25 has been deleted from cover piece 24 and cover piece 24 is now indicated as cover piece **24*a*, and notch 13 has been eliminated from cap body piece 10 which is now indicated as cap body piece 10*a*. To indicate proper alignment of cap body piece 10*a* and cover piece 24*a* and button 26, a small protuberance 24*b* is molded into the inner wall of cover piece 24*a* and two shoulders 10*b*—10*b* are provided on the outside of cap body piece 10*a* at 180° from the same location which V-notch 13 was formerly placed. Protuberance 24*b* is positioned at an appropriate height on cover piece 24*a* to contact and strike shoulders 10*b*—10*b* as cover piece 24*a* is being rotated relative to cap body piece 10*a*. Thus, to align the actuator assembly for dispensing fluids, the cover piece 24*a* is rotated until protuberance 24*b* strikes one of the shoulders 10*b*—10*b*, then a slight additional force is exerted to rotate protuberance 24*b* into position between shoulders 10*b*—10*b***. At this point, the assembly is ready for dispensing fluids.

Figure 8:
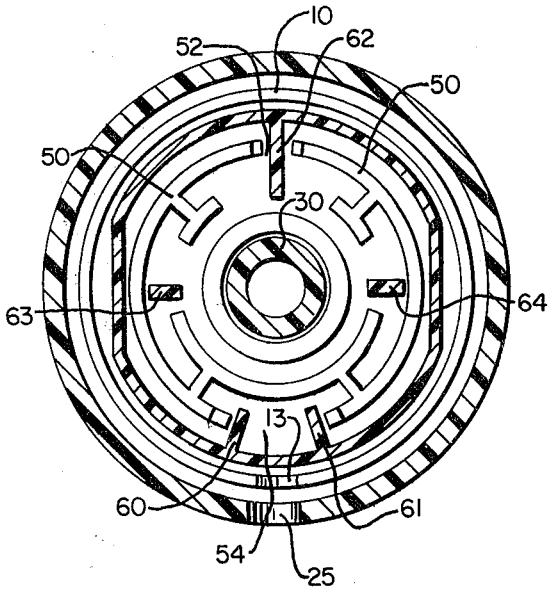
FIG. 8 is a cross-sectional view taken along lines 8—8 of FIG. 1.

In FIGS. 8 and 9 the pump asembly is shown rotated to the position for dispensing fluid. Cover 24 and button 26 have been positioned so that tab 62 is aligned over slot 52 and tabs 60 and 61 are aligned over slot 54. This alignment may be accomplished by aligning hole 25 with slot 13 in one embodiment of this invention or by locating protuberance **24*b* between shoulders 10*b*—10*b* as shown in FIG. 9. Tabs 63 and 64 can be received within the inner wall of protuberances 50—50 to stabilize the button 26** as it is depressed downwardly.

Figure 8A:
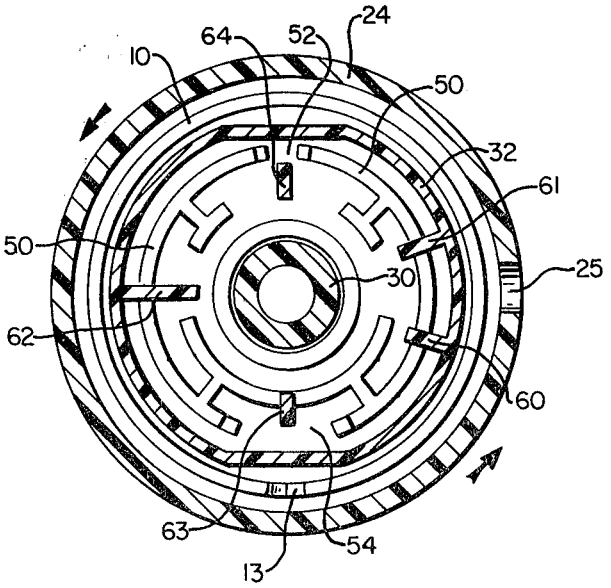
FIG. 8A is a cross-sectional view taken along lines 8—8 of FIG. 1 in which the pump assembly has been rotated from the position shown in FIG. 8.

When the cover 24 and button 26 are turned to the position shown in FIG. 8A or in any other position other than that shown in FIG. 8, the pump assembly cannot be actuated to dispense fluids. In the position shown in FIG. 8A or in any position other than that shown in FIG. 8, the tabs 62 or 61 and 60 will strike the top 56 of protuberances 50—50 therefore preventing actuation.

Shown in FIGS. 10–17A is a third embodiment of the present invention. This embodiment is similar to the first and second embodiments previously disclosed in drawings 1 through 9. Numbers 100 and above indicate the additional portions of the third embodiment.

The principal features of the third embodiment are two small triangular protuberances 100 and 101 extending outwardly from cap body piece 10 and a larger protuberance 102 which extends outwardly from cap body piece 10, and two protuberances 103 and 104 which extend inwardly from cover piece 24.

Figure 10:
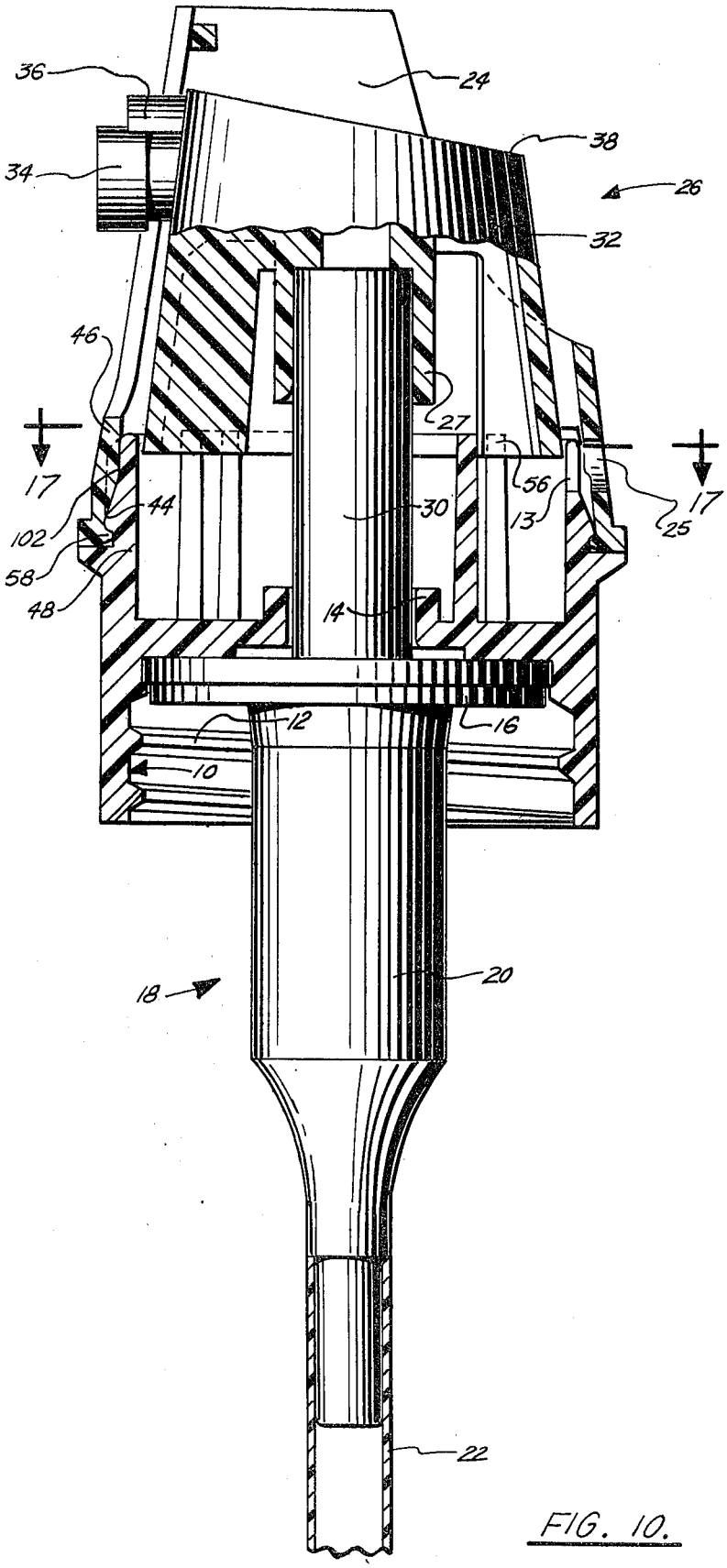
FIG. 10 is a partly sectional, side elevational view of a third embodiment of the assembly of the present invention.
Figure 11:
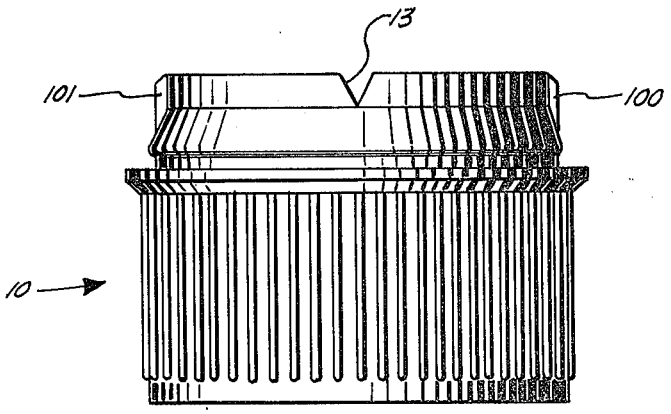
FIG. 11 is a side elevational view of the cap body piece of the third embodiment of the present invention.

The view shown in FIG. 10, which shows an assembly similar to that shown in FIG. 1, indicates at 102 a new protuberance on cap body piece 10 and in FIG. 11 the cap body piece can be seen to have protuberances 100 and 101 extending from the sides thereof.

Figure 12:
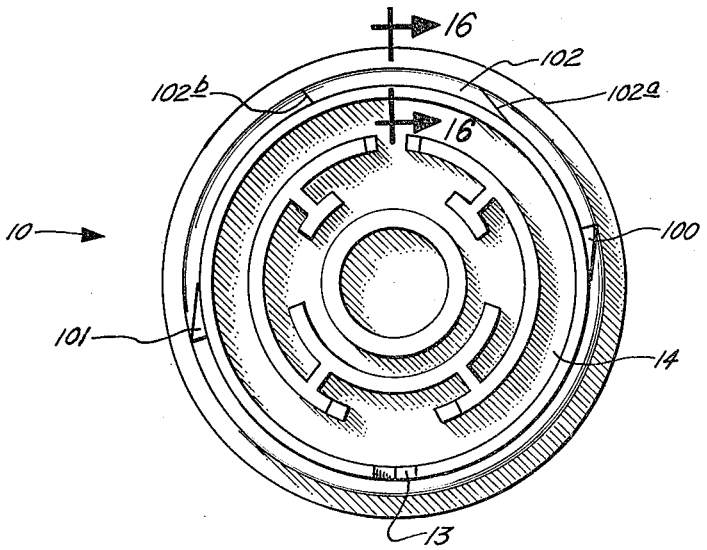
FIG. 12 is a top plan view of the cap body piece of the third embodiment of the present invention.

In FIG. 12 the protuberances from cap body piece 10 can be seen more clearly. The two triangular protuberances 100 and 101 are 180° apart. The larger protuberance 102 is located approximately in the middle of 100 and 101 but biased somewhat toward protuberance 100. Protuberance 102 has a sloping leading edge **102*a* and a trailing edge 102*b***.

Figure 13:
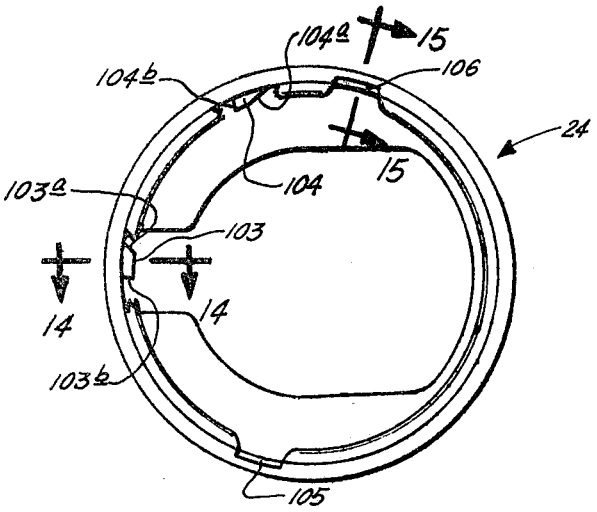
FIG. 13 is a bottom, partly cut-away view of the cover piece of the third embodiment of the present invention.
Figure 15:
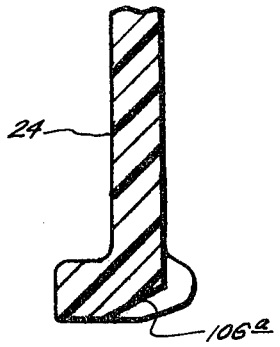
FIG. 15 is a partly cut-away sectional view taken along lines 15—15 of FIG. 13.

In FIG. 13 the protuberances 103 and 104 on the cover piece 24 can be seen to be somewhat closer than 90° apart. These two protuberances 103 and 104 have tapered leading edges **103*a* and 104*a* which permit the protuberances to slide more easily over protuberances 100, 101 and 102. Also, the trailing edges 103*b* and 104*b* of protuberances 103 and 104** prevent the cover piece from being rotated 360° in the direction of the trailing edge.

For ease in assembling the cover piece 24 to the cap body piece 10, two notches 105 and 106 are located in the bottom of the cover piece 24. These notches 105 and 106 are shown in cross-section in FIG. 15 and have a tapered bottom edge **106*a* which further aids in forcing the cover piece 24 downwardly onto cap body piece 10. To assemble, the cap body piece 10 and the cover piece 13 are oriented so that triangular protuberances 100 and 101 of cap body piece 10 are received within notches 105 and 106. The cover piece can then be forced downwardly and easily snapped into rotating engagement with the cap body piece 10**.

Figure 14:
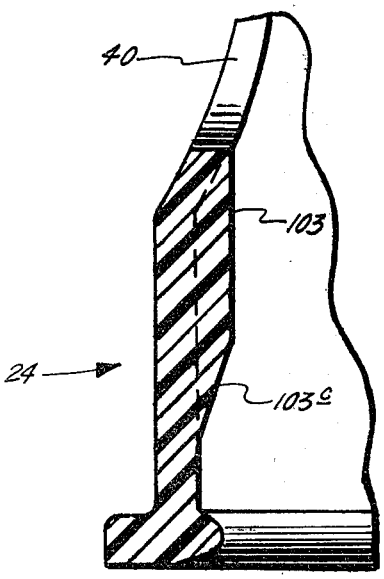
FIG. 14 is a partly cut-away sectional view taken along lines 14—14 of FIG. 13.

As can be seen in FIG. 14, the protuberance 103 has a tapered lower edge **103*c* which aids in forcing cover piece 24 downwardly onto cap body piece 10. When notches 105 and 106 are aligned over protuberances 100 and 101, protuberance 103 is directly over protuberance 102 on cap body piece 10** and, therefore, must ride over this protuberance when assembled.

Figure 16:
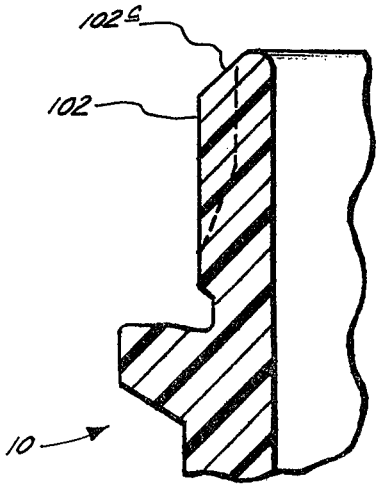
FIG. 16 is a partly cut-away sectional view taken along lines 16—16 of FIG. 12.

In FIG. 16 is shown protuberance 102 in cross-section. Protuberance 102 can be seen to have a tapered top **102*c* which cooperates with tapered lower edge 103*c* of protuberance 103** during assembly, as previously mentioned.

Figure 17:
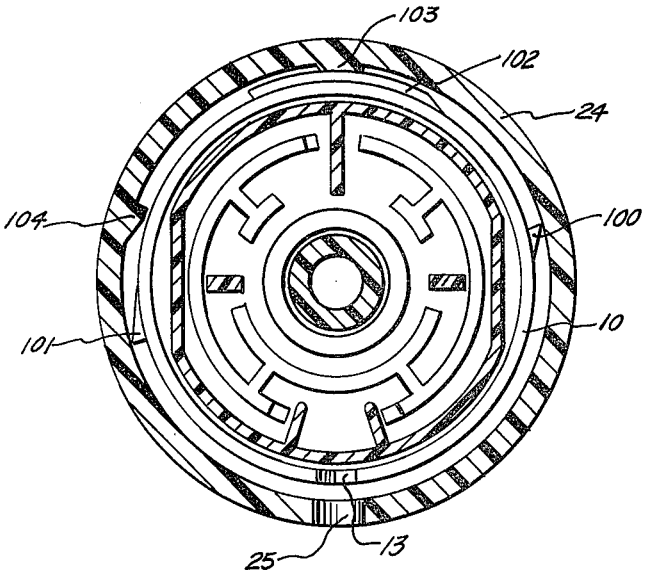
FIG. 17 is a cross-sectional view taken along lines 17—17 of FIG. 10; and, FIG. 17A is a cross-sectional view of FIG. 17 in which the pump assembly has been rotated from the position shown in FIG. 17.
Figure 17A:
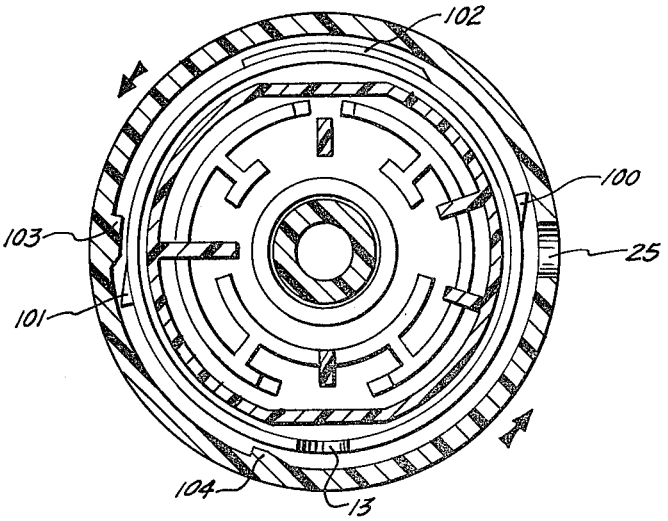

As can be seen most clearly in FIGS. 17 and 17A, the protuberances on the cover piece 24 and cap body piece 10 cooperate so that when viewed from above as in FIGS. 17 and 17A, the cap body piece can only be rotated in a full circle in the direction indicated by the arrows in FIG. 17A. As the cap body piece is rotated in the direction indicated by the arrows in FIG. 17A, a series of clicks are heard as the protuberances ride over each other and snap downwardly as they complete rotation past each other. This clicking noise is audible to the person trying to orient the dispenser in the dispensing position.

The dispensing position is shown in FIG. 17. In this position, it can be seen that protuberance 103 is riding in the proximate center of 102. To achieve this alignment the cap must be turned carefully so that hole 25 aligns with V-notch 13. At the dispensing position shown in FIG. 17, the cover piece may be rotated relative to the cap body piece in the direction indicated by the arrows or in the opposite direction a short distance until the trailing edge of protuberance 104 strikes the trailing edge of protuberance 102. Thus, when the cap is in the dispensing mode it can be turned easily in either direction. Therefore, the dispensing mode is difficult for a child to find especially because there is a series of clicks which tend to mislead the child. Thus, the assembly of the present invention is very difficult for a child to place in the dispensing mode.

Although the preferred embodiments of the present invention have been disclosed and described in detail above, it should be understood that the invention is in no sense limited thereby and its scope is to be determined by that of the following claims:

What is claimed:

1. An actuator assembly for a dispensing device comprising, in combination:

a. a cap body piece having
   i. means for attachment to a container,
   ii. an exterior peripheral surface for engagement by the fingers of the user to enable said cap body piece to be manually screwed onto said container neck,
   iii. side walls connected by a flange having a hole therein for receipt of pump plunger means,
   iv. two arcuate protuberances projecting upwardly from said flange inside said side walls to define a first slot and a second slot, said first slot being larger than said second slot;

b. a generally round, operable dispensing button and means mounting said button on said cap body piece for both rotation through 360 degrees and axial movement while preventing tilting movement, said button having a downwardly extending skirt with a lower edge fitting closely within said sidewalls and having three tabs projecting radially inwardly from said skirt, two of said tabs being arranged close enough together to be received within said first slot and the remaining tab being arranged to be received in said second slot when said button is positioned in the dispensing mode permitting axial movement of said button;

c. a cover piece enclosing said button and adapted to expose a portion of the button for finger engagement; and, d. a guide on said button and said cover piece for preventing relative turning therebetween while enabling relative axial movement to be had.

2. The assembly of claim 1 wherein said cover piece has a single protuberance on the inside thereof for receipt between a single pair of shoulders provided on the outside of said cap body piece to thereby indicate that said assembly is positioned in the dispensing mode.

3. An actuator assembly for a dispensing device comprising, in combination:

a. a cap body piece having
   i. means for attachment to a container,
   ii. an exterior peripheral surface for engagement by the fingers of the user to enable said cap body piece to be manually screwed onto said container neck,
   iii. side walls connected by a flange having a hole therein for receipt of pump plunger means,
   iv. two arcuate protuberances projecting upwardly from said flange inside said side walls to define a first slot and a second slot, said first slot being larger than said second slot,
   v. protuberances on the outside thereof;

b. a generally round, operable dispensing button and means movably mounting said button on said cap body piece for both turning and axial movement, said button having three tabs therein, two of said tabs being arranged to be received within said first slot and the remaining tab being arranged to be received in said second slot when said button is positioned in the dispensing mode;

c. a cover piece enclosing said button and adapted to expose a portion of the button for finger engagement, said cover piece having a hole therein for alignment with a V-notch on the outside of said cap body piece to visually indicate said assembly as is positioned for dispensing, said cover piece having protuberances on the inside thereof which cooperate with said protuberances on the inside of said cap body piece to permit 360° rotation of said cap body piece relative to said cover piece in only one direction; and, d. a guide on said button and said cover piece for preventing relative turning therebetween while enabling relative axial movement to be had.

4. The assembly of claim 3 wherein said cap body piece has three of said protuberances thereon.

5. The assembly of claim 4 wherein two of said protuberances are triangular in horizontal cross-section.

6. The assembly of claim 5 wherein said triangular protuberances are 180° apart.

7. The assembly of claim 4 wherein one of said protuberances has a curved outer surface and said protuberance is located radially outwardly from said second slot.

8. The assembly of claim 3 wherein said cover piece has two of said protuberances therein.

9. The assembly of claim 8 wherein said two protuberances are less than 90° apart.

10. The assembly of cliam 9 wherein said cover piece has two slots therein for alignment with two of said protuberances on said cap body piece to lessen the force required to attach said cover piece to said cap body piece.

11. The assembly of claim 3 wherein said arcuate protuberances project upwardly from said flange.

12. The assembly of claim 3 wherein said button has discharge nozzle means.

13. The assembly of claim 3 wherein said container has a threaded neck and said cap body piece has screw threads therein for engagement with said threaded neck.

14. The assembly of claim 13 wherein a friction mounting means is located on said cover piece and a portion of said cap body piece which is located entirely above the said finger engagable peripheral surface thereof, yieldably holding said cover piece and said button in different adjusted rotative positions with respect to said cap body piece, thereby to enable said cover piece and said button to be rotatably adjusted with respect to a container on which said cap body piece is screwed all without closing said peripheral surface or interfering with the screwing on or unscrewing of said cap body piece.

* * * * *